United States Patent [19]

Toya

[11] Patent Number: 4,547,452

[45] Date of Patent: Oct. 15, 1985

[54] COLOR DIFFUSION TRANSFER PHOTOGRAPHIC ELEMENT WITH SUFINIC ACID

[75] Inventor: Ichizo Toya, Kanagawa, Japan

[73] Assignee: Fuji Photo Film Co., Ltd., Japan

[21] Appl. No.: 537,208

[22] Filed: Sep. 29, 1983

[30] Foreign Application Priority Data

Sep. 29, 1982 [JP] Japan ..... 57-170077

[51] Int. Cl.[4] ..... G03C 5/54; G03C 1/40; G03C 5/30

[52] U.S. Cl. ..... 430/216; 430/212; 430/218; 430/372; 430/490; 430/559; 430/607; 430/611; 430/497

[58] Field of Search ..... 430/212, 214, 216, 372, 430/551, 559, 490, 491, 611, 607, 218, 488, 489, 493, 497

[56] References Cited

U.S. PATENT DOCUMENTS

| | | | |
|---|---|---|---|
| 2,057,764 | 10/1936 | Brunken | 430/607 |
| 3,466,173 | 9/1969 | Ishikawa et al. | 430/607 |
| 3,615,534 | 10/1971 | Tajima et al. | 430/607 |
| 3,880,658 | 4/1975 | Lestina et al. | 430/226 |
| 3,960,569 | 6/1976 | Ono | 430/218 |
| 4,294,921 | 10/1981 | Yamaguchi et al. | 430/621 |
| 4,352,873 | 10/1982 | Toda et al. | 430/551 |
| 4,358,534 | 11/1982 | Sasaki et al. | 430/372 |

OTHER PUBLICATIONS

"Photographic Processes and Products", *Research Disclosure*, No. 15162, 11/1976.

*Primary Examiner*—Richard L. Schilling
*Attorney, Agent, or Firm*—Sughrue, Mion, Zinn, Macpeak, and Seas

[57] ABSTRACT

A color diffusion transfer photographic element containing a compound having a sulfinic acid group or a slat thereof is disclosed. The element is comprised of a photosensitive element and an alkaline processing composition element. The sufinic acid group or a salt thereof includes a compound represented by the general formula $(Y\text{-}SO_2)_nM$ wherein M is a hydrogen atom, an alkyl metal atom, an alkaline earth metal atom, an ammonium group, or an organic base; Y is an alkyl group, a substituted alkyl group, an aryl group or a substituted aryl group, and n is 1 or 2. By utilizing the compound within the processing solution it is possible to prevent the deterioration of processing composition which occurs when the material is stored for a long period of time.

21 Claims, No Drawings

COLOR DIFFUSION TRANSFER PHOTOGRAPHIC ELEMENT WITH SUFINIC ACID

FIELD OF THE INVENTION

The present invention relates to a color photographic element and, more particularly, to a color diffusion transfer photographic element.

BACKGROUND OF THE INVENTION

Color diffusion transfer photographic elements which provide a transferred dye image in a mordant layer are known by, for example, U.S. Pat. Nos. 3,415,644, 3,415,645, 3,415,646, 3,647,487, 3,635,707, 3,993,486, 3,594,164, 3,594,165, 3,689,262, 3,730,718, 3,658,524, 2,759,825, 3,370,950 and 3,291,610, British Pat. No. 1,330,524, and Canadian Pat. No. 674,082. However, known color diffusion transfer photographic elements tend to form stains (mostly yellow in color) with the lapse of time in white areas of print formed. There has, therefore, been a strong desire for a means for preventing the white areas of print images from being stained when stored for a long time.

There is also a tendency for processing compositions for color diffusion transfer photographic elements to deteriorate with the lapse of time even when contained in an oxygen-shielding container made of a polymer-coated lead foil.

Accordingly, it has also been desired to develop a technique for providing an image whereby the quality of the background portion of the print image does not deteriorate when the print is stored for a long period of time.

SUMMARY OF THE INVENTION

It is, therefore, an object of the present invention to prevent the lowering of the $D_{max}$ in print images caused by the deterioration of processing compositions during storage.

It has now been discovered that the foregoing object of this invention is attained by using a color diffusion process photographic element containing at least one compound selected from aliphatic sulfinic acids or salts thereof and aromatic sulfinic acids or salts thereof.

The foregoing object of this invention is preferably attained by the incorporation of the compound shown by the following general formula (I)

$$(Y—SO_2)_nM \qquad (I)$$

wherein M represents a hydrogen atom, an alkali metal such as sodium, potassium, etc., an alkaline earth metal such as calcium, magnesium, etc., an organic base such as triethylamine, trimethylamine, etc., or an ammonium group (—$NH_4$); Y represents an alkyl group, a substituted alkyl group, an aryl group, or a substituted aryl group; and n is 1 or 2.

DETAILED DESCRIPTION OF THE INVENTION

The total carbon number of the alkyl group or the substituted alkyl group shown by Y described above is preferably 5 to 30, more particularly 8 to 24 and the alkyl group may be a straight chain or branched one. Examples of the substituent of the substituted alkyl group are a hydroxy group, a carboxy group, a sulfonic acid group, an amino group, a nitro group, an alkoxy group wherein the alkyl residue has 1 to 5 carbon atoms, a phenyl group, and a halogen atom such as chlorine atom, etc.

Examples of the aryl group shown by Y are a phenyl group and a naphthyl group and examples of the substituent of the substituted aryl group are, for example, an alkyl group having 1 to 18 carbon atoms, an alkenyl group having 1 to 18 carbon atoms (e.g., vinyl group), an alkoxy group wherein the alkyl residue has 1 to 5 carbon atoms, a hydroxy group, a carboxy group, a sulfonic acid group, an amino group, a nitro group, a phenyl group, and a halogen atom (e.g., chlorine atom, etc.).

Practical examples of the sulfinic compounds used in this invention are shown below.

1.
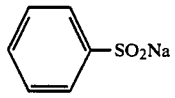

2.
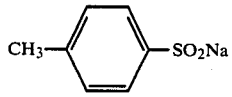

3.
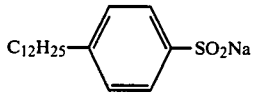

4.
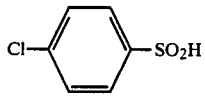

5.
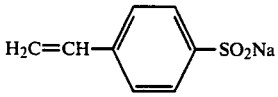

6.
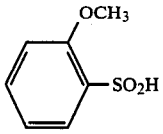

7.
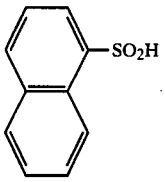

8.
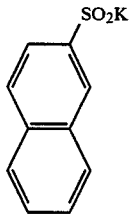

9. $C_8H_{17}SO_2Na$

10. $C_{16}H_{33}SO_2Na$

-continued

11. 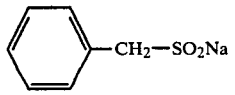

12. 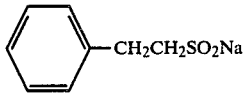

13. 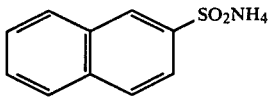

14. 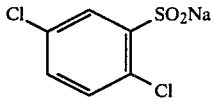

15. 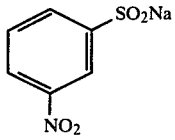

Compounds 1 to 15 are preferred compounds, particularly preferred compounds are Compounds 1, 2, 5, 9 and 10.

Synthesis examples of the foregoing compounds are shown below.

SYNTHESIS EXAMPLE 1

Compound 3

To a solution composed of 32.7 g (0.1 mol) of dodecylbenzenesulfonic acid, 80 ml of ethyl acetate, and 12 ml of dimethylformamide (DMF) was added dropwise 12.4 ml (0.15 mol) of phosphorus oxychloride with stirring over a period of 10 minutes and then while heating the mixture so as to maintain the temperature thereof at 40° C., the reaction was performed for 60 minutes. After the reaction was over, the reaction mixture was cooled to 5° to 10° C. and then a solution composed of 16 g of sodium chloride and 160 ml of water was added dropwise to the reaction mixture over a period of 15 minutes. After removing an aqueous layer, an ethyl acetate layer thus formed was washed once with 100 ml of an aqueous 10% sodium chloride solution. The ethyl acetate solution of dodecylbenzenesulfonyl chloride obtained was used for the subsequent reaction as it was.

A solution composed of 38 g (0.3 mol) of sodium sulfite, 160 ml of water, 8 g of sodium hydroxide was heated to 50° to 55° C. with stirring and the total amount of the aforesaid ethyl acetate solution of dodecylbenzenesulfonyl chloride was added dropwise to the solution over a period of 5 minutes. While maintaining the temperature of the mixture at 50° to 55° C., the reaction was performed for 30 minutes. After allowing the reaction mixture to cool to room temperature, 3.2 g of sodium carbonate and then 1.6 g of sodium hydroxide were added to the reaction mixture. After removing an aqueous layer, an ethyl acetate layer thus formed was washed twice, each time with an aqueous 10% sodium chloride solution and then ethyl acetate was distilled off to provide desired crystals. The melting point thereof was higher than 200° C.

Compound 5

The compound was prepared by following the same procedure as in the case of preparing Compound 3 using sodium p-styrenesulfonate as a starting material. The melting point of the product was higher than 200° C.

Compound 4

The compound was prepared by a process described in Kulka, *J. Am. Chem. Soc.*, 72, 1216 (1950). The melting point was 99° C.

Compound 6

The compound was prepared by a process described in Gattermann, *Ber.*, 32, 1136 (1899). The melting point was 99° C.

Compound 7

The compound was prepared by a process described in Gattermann, *Ber.*, 32, 1136 (1899). The melting point was 85° C.

Compound 8

The compound was prepared by a process described in Malfe, Wright, *J. Chem. Soc.*, 1490 (1938). The melting point was higher than 200° C.

Compound 9

The compound was prepared by a process described in Allen, *J. Org. Chem.*, 7, 23 (1942). The melting point of the compound was 100° C. (dec.).

Compound 10

The compound was prepared by a process described in Allen, *J. Org. Chem.*, 7, 23 (1942). The melting point was 165° C.

Compounds 1 and 2 are available from Tokyo Kasei Kogyo K.K.

Other compounds shown by general formula (I) than the aforesaid compounds can be also prepared by the same procedures described above.

The compound according to the present invention can be incorporated in any layer composing color diffusion transfer photographic element, or a close layer thereto. The compound is preferably incorporated in an alkaline processing composition element, a cover sheet, a light-sensitive element or a dye image-receiving element of the color diffusion transfer photographic element. Most preferably, the compound can be incorporated in the alkaline processing composition.

The color diffusion transfer photographic element to which the sulfinic acids or salts thereof can be applied comprises a light-sensitive element and an alkaline processing composition element. The light-sensitive element contains a silver halide emulsion layer associated with a dye image-providing material, and a dye image-receiving layer, i.e., a mordant layer. Further, the light-sensitive element may have a support, a protective layer and/or a neutralizing layer, if required.

As another embodiment of the color diffusion transfer photographic element, it may contain a cover sheet having a neutralizing system, the above-described light-sensitive element and the alkaline processing composition element. Further, a dye image-receiving element having a mordant layer can be placed in the color diffusion transfer photographic element instead of placing the dye image-receiving layer in the light-sensitive element. The dye image-receiving element may have a support.

The amount of the foregoing compound used in the present invention is preferably 0.01 to 100 g, in particular, 0.1 to 50 g per square meter of an alkaline processing composition after spreading for processing. The above-mentioned amount is also applicable to a coverage of the compound when the compound is incorporated in a layer composing the color diffusion transfer photographic element or in an adjacent layer thereto.

In the color diffusion transfer photographic element of the present invention, silver halide emulsions are associated with dye image-providing material, preferably, dye releasing redox compounds.

Silver halide emulsions used in the present invention may be hydrophilic colloidal dispersions of silver chloride, silver bromide, silver chlorobromide, silver iodobromide, silver chloroiodobromide or mixtures thereof, and their halogen compositions may be selected in accordance with uses and processing conditions applied thereto. Silver bromide emulsions and silver iodobromide or chloroiodobromide emulsions containing less than 10% by mol of iodide and less than 30% by mol of chloride are particularly preferable. Silver halides used can be of ordinary grain size, as well as of fine grain size. The grain size is preferably from about 0.1 to about 2 microns on the average. Emulsions having a uniform grain size are preferably used for certain purposes. The grains may be either cubic, octahedral or mixed crystallines. These silver halide emulsions can be prepared by known and conventional methods, as described by P. Glafkides, *Chimie Photographique,* chapters 18 to 23, 2nd Edition (1957), published by Paul Montel, Paris. Silver halide emulsions used in the present invention can be preferably chemically sensitized, for example, by natural sensitizers contained in gelatin; sulfur sensitizers, such as sodium thiosulfate and N,N,N'-triethylthiourea; gold sensitizers, such as thiocyanate and thiosulfate complexes of monovalent gold; reduction sensitizers, such as stannous chloride and hexamethylenetetramine, or the like. In the present invention, there may be used a variety of emulsions, includine, e.g., those which form latent images mainly on the surface of grains; internal latent image type emulsions as described in U.S. Pat. Nos. 2,592,550 and 3,206,313; and direct reversal and solarization emulsions utilizing desensitizing dyes.

Useful solarization emulsions include those described by Mees, *The Theory of the Photographic Process,* pp. 261 to 297 (1942), Macmillan Co., New York. Preparations of such emulsions are described, for example, in British Pat. Nos. 443,245 and 462,730, and U.S. Pat. Nos. 2,005,837, 2,541,472, 3,367,778, 3,501,305, 3,501,306 and 3,501,307.

Internal latent image type silver halide emulsions which can be used with advantage in the present invention are emulsions having sensitivity centers mainly in the inner parts of silver halide grains and capable of forming latent images selectively in the inner parts of grains with only minor quantities of latent images on the surface of grains. Such internal latent type silver halide emulsions can be characterized by the fact that the amount of image silver given by a surface developer (proportional to the amount of surface images) is distinctly smaller than that given by an internal developer (proportional to the amount of total latent images), as is described by T. H. James, *The Theory of Photographic Process,* pp. 171 to 176, Fourth Edition (1977). Internal latent image type silver halide emulsions can be prepared by various methods. Examples of emulsions of this type include Burton emulsions having a high iodide content and produced by an ammoniacal method (see E. J. Wall, *Photographic Emulsions,* pp. 35 to 36 and 52 to 53 (1929), American Photographic Publishing Co., and U.S. Pat. Nos. 2,497,875 and 2,563,785); coarse primitive emulsions having a low iodide content and produced by an ammoniacal method (see German Patent Application (OLS) No. 2,728,108); emulsions prepared by precipitating silver halide grains through a rapid lowering in the concentration of ammonia in a silver halide-ammonium complex emulsion (see U.S. Pat. No. 3,511,662); conversion emulsions prepared by the catastrophe precipitation method which comprises the preparation of silver salt grains with a high solubility, such as silver chloride grains, followed by the conversion thereof into less soluble silver salt grains, such as silver bromide and iodobromide (see U.S. Pat. No. 2,592,250); core-shell emulsions comprising core grains covered with silver halide shells, which are prepared by mixing a chemically sensitized coarse grain emulsion (core emulsion) with a fine grain emulsion, followed by ripening thereof (see U.S. Pat. No. 3,206,313 and British Pat. No. 1,011,062); core-shell emulsions comprising core grains covered with silver halide shells prepared by simultaneously adding a solution of soluble silver salts and a solution of soluble halides to a chemically sensitized monodisperse core emulsion while maintaining the silver ion concentration at a constant level (see British Pat. No. 1,027,146 and U.S. Pat. No. 3,761,276); halogen localized emulsions containing silver halide grains having a laminated layer structure of two or more layers of different halogen compositions (see U.S. Pat. No. 3,935,014); emulsions containing adsorbed foreign metals prepared by forming silver halide grains in an acidic medium containing a trivalent metal ion (see U.S. Pat. No. 3,447,972); and the like.

Direct-positive photographic emulsions as disclosed in British Pat. No. 2,110,831 and U.S. Pat. No. 4,395,478 are also used in the present invention.

Typical examples of fogging agents used for emulsions of the above-described types include hydrazines described in U.S. Pat. Nos. 2,558,982 and 2,563,785; hydrazides and hydrazones described in U.S. Pat. No. 3,227,552; and quaternary salts described in British Pat. No. 1,283,835, Japanese Patent Publication No. 38164/74, and U.S. Pat. Nos. 3,734,738, 3,719,494 and 3,615,615.

It is also possible to use in the present invention dye releasing compounds in combination with DIR reversal emulsions as described in U.S. Pat. Nos. 3,227,551, 3,227,554 and 3,364,022, or reversal emulsions utilizing solution physical development as described in British Pat. No. 904,364.

Silver halide emulsions used in the present invention can be stabilized by such additives as 4-hydroxy-6-methyl-1,3,3a,7-tetraazaindene, 5-nitroimidazole, 1-phenyl-5-mercaptotetrazole, 8-chloromercuricquinone, pyrocatechin, 4-methyl-3-sulfoethylthiazolidine-2-thione and 4-phenyl-3-sulfoethylthiazolidine-2-thione. Inorganic compounds, such as cadmium salts, mercury salts and complexes of platinum group metals (e.g., chloropalladium complex) can also be useful for the stabilization of the photographic element used in the present invention. The silver halide emulsions used in the present invention can also be incorporated with such sensitizing compounds as polyethylene oxide compounds.

The silver halide emulsions used in the present invention can have color sensitivities extended, if desired, by spectral sensitizing dyes. Examples of useful spectral sensitizers include cyanines, merocyanines, holopolar cyanines, styryls, hemicyanines, oxonols, hemioxonols, and the like.

Specific examples of spectral sensitizers are described in chapters 35 to 41 of aforementioned literature written by P. Glafkides, and by F. M. Hamer, *The Cyanine and Related Compounds,* Interscience Co. Of these spectral sensitizers, cyanine dyes having a nitrogen atom contained in a basic heterocyclic nucleus and substituted with a fatty group (e.g., alkyl group) having a hydroxyl, carboxyl or sulfo group can be particularly preferable for the practice of the present invention. Examples of such cyanine dyes are described, for example, in U.S. Pat. Nos. 2,503,776, 3,459,553 and 3,177,210.

The light-sensitive element used in the color diffusion transfer photographic element according to the present invention can be coated on a plane substance which shows no marked dimensional changes during processings. Examples of such supports include those used for conventional photographic materials, such as cellulose acetate films, polystyrene films, polyethylene terephthalate films, polycarbonate films, laminated products of these films, and thin glass plates.

When the adhesion between the support and the photographic emulsion layer is insufficient, there can be provided a subbing layer which adheres to both of them. The surface of the support can be subjected to a pretreatment, such as corona discharge, UV irradiation and flame treatment, in order to further improve the adhesiveness thereof.

Other examples of usable supports include paper and papers laminated with a water-impermeable polymer, such as polyethylenes.

Integrated products according to the present invention can be produced in accordance with the layer arrangement described in Japanese Patent Application (OPI) No. 33630/76, Japanese Patent Publication No. 16356/71 and U.S. Pat. No. 3,594,164.

The light-sensitive element to which the present invention can be applied can comprise a silver halide emulsion layer associated with a dye image-providing material, e.g., a dye releasing redox compound. Combinations of color sensitivity of the silver halide emulsion and the spectral absorption of dye image can be selected according to color reproduction desired. For the reproduction of natural colors based on the subtractive process, there can be used a light-sensitive element comprising at least two combinations of an emulsion having a selective spectral sensitivity in a certain region of the spectrum and a dye image-providing compound having a selective spectral absorption in the same region of the spectrum. Particularly useful light-sensitive elements include those comprising a combination of a blue-sensitive silver halide emulsion and a yellow dye releasing redox compound; a combination of green-sensitive emulsion and a magenta dye releasing redox compound; and a combination of a red-sensitive emulsion and a cyan dye releasing redox compound. These combination units comprising an emulsion and a dye releasing redox compound can be incorporated into separate layers superposed each other, or can be mixed together in the form of particles and incorporated into one single layer. In a preferable multilayer structure, there are provided a combination unit of a blue-sensitive emulsion, a combination unit of a green-sensitive emulsion and a combination unit of a red-sensitive emulsion, in that order from the exposure side. In cases where high speed emulsions containing silver iodide are used, a yellow filter layer is preferably positioned between the combination unit of a blue-sensitive emulsion and the combination unit of a green-sensitive emulsion. The yellow filter layer can contain dispersions of yellow colloidal silver, dispersions of oil-soluble yellow dyes, acidic dyes mordanted with basic polymers, basic dyes mordanted with acidic polymers, or the like. The combination units can be advantageously separated from each other by interlayers. The interlayers prevent undesirable interactions between combination units having different color sensitivities. The interlayers can be composed of a hydrophilic polymer, such as gelatin, polyacrylamides and partially hydrolyzed products of polyvinyl acetates; porous polymers produced from a latex of hydrophilic and hydrophobic polymers as described in U.S. Pat. No. 3,625,685; or a polymer of which hydrophilicity can be gradually enhanced by processing solutions, such as calcium alginate as described in U.S. Pat. No. 3,384,483.

In order to prevent the diffusion of oxidized developers into other combination units having different color sensitivities, the interlayers can also be incorporated with a compound capable of capturing such oxidized products, such as a color contamination-preventing agents, for example, 2,5-di(sec-dodecyl)hydroquinone.

The processing composition which forms the processing composition element used in the present invention can be a liquid composition comprising processing components necessary for the development of silver halide emulsions and for the formation of diffusion transferred dye images or for the formation of dye images remaining in the original layer after the diffusion of released dyes. The processing composition contains water as the main solvent and may be additionally incorporated with such hydrophilic solvents as methanol and 2-methoxyethanol. The processing composition contains an alkali in an amount sufficient to maintain the pH necessary for the development of emulsion layers and to neutralize acids (e.g., hydrohalogenic acids, such as hydrobromic acid) generated in the course of development and dye image-forming processes.

Any silver halide developing agent capable of undergoing cross oxidation with dye releasing redox compounds can be used in the processing composition according to the present invention. The amount of the developing agent is 0.001 to 0.1 mol based on 1 l of alkaline processing composition. Such developing agents can be incorporated into light-sensitive elements as long as they can be activated when the development of silver halides is substantially started by the alkaline processing composition. In other words, the developing agent (electron transfer agent) may be a precursor thereof. A specific example of the precursor is a compound which forms a developing agent by hydrolysis in an alkaline condition.

Specific examples of such developing agents include 3-pyrazolidinones, such as 1-phenyl-3-pyrazolidinone, 4,4-dimethyl-1-phenyl-3-pyrazolidinone, 4-hydroxymethyl-4-methyl-1-phenyl-3-pyrazolidinone, 4-hydroxymethyl-4-methyl-1-tolyl-3-pyrazolidinone, 4-hydroxymethyl-4-methyl-1-(4'-methoxyphenyl)-3-pyrazolidinone, 4,4-bis(hydroxymethyl)-1-phenyl-3-pyrazolidinone, 4-hydroxymethyl-4-methyl-1-(3'-methylphenyl)-3-pyrazolidinone, 4,4-bis(hydroxymethyl)-1-tolyl-3-pyrazolidinone, 4,4-bis(hydroxymethyl)-

1-(4'-methoxy-phenyl)-3-pyrazolidinone, 4,4-dimethyl-1-tolyl-3-pyrazolidinone and 1,5-diphenyl-3-pyrazolidinone; aminophenols, such as p-aminophenol, p-methylaminophenol, p-dimethylaminophenol, p-dibutylaminophenol, p-piperidinophenol and 4-dimethylamino-2,6-dimethoxyphenol; and hydroquinones.

In the present invention, the staining in white areas of images which may appear with the lapse of time can be prevented with particular effectiveness by using 3-pyrazolidinones as a developing agent. Ths staining can also be prevented by using 3-pyrazolidinones as an auxiliary developing agent.

Alkali-providing substance in the alkaline processing composition used in the present invention include alkali metal hydroxides, such as sodium hydroxide, potassium hydroxide, rubidium hydroxide and cesium hydroxide. It is also possible to use sodium carbonate or amines such as diethylamine, as an alkali-providing substance. Preferably, the alkaline processing composition is provided with a pH value exceeding 11, preferably exceeding 12, through the incorporation of these alkali-providing substances.

The alkaline processing composition used in the present invention is preferably incorporated with an additive for increasing its viscosity. Examples of such an additive include ethers which are inactive in alkaline solutions, such as hydroxyethyl cellulose and alkali metal salts of carboxymethyl celluloses (e.g., sodium carboxymethyl celluloses). The content of the additive can be preferably from 1 to 10% by weight of the total weight of the processing composition. Viscosity of the processing composition is preferably from about 100 to about 200,000 cps. It is also possible to use such viscosity-increasing compounds as polysaccharide gums (e.g., guar gums), xanthanes and algins, as described in *Research Disclosure,* No. 15162 (published in November, 1976).

The alkaline processing composition used in the present invention is preferably incorporated with such opacifying agents as carbon black, titanium dioxide and light-absorbing dyes (e.g., indicator dyes). It is preferable to use indicator dyes which are transparent at the time of exposure and, when contacted with the alkali from the alkaline processing composition, are converted into colored or opaque form.

The photographic element of the present invention can be additionally incorporated with a variety of compounds as described hereinbelow, preferably in the alkaline processing composition, in accordance with their uses.

In order to increase the densities of transferred images, the photographic element of the present invention can be incorporated with aromatic alcohols, such as benzyl alcohol, p-xylene-$\alpha,\alpha'$-diol, etc., as described in U.S. Pat. No. 3,846,129; as well as fatty or alicyclic glycols and saturated fatty or alicyclic aminoalcohols, such as 1,4-cyclohexanedimethanol, 1,6-hexanediol, 3-amino-1-propanol, 2-amino-1-propanol, 5-amino-1-pentanol, 6-amino-1-hexanol, 2-amino-2-methyl-1-propanol, etc., as is known by U.S. Pat. No. 4,030,920. Other examples of additives for increasing $D_{max}$ include colloidal silica and potassium iodide described in *Research Disclosure,* No. 15162 (published in November, 1976).

For the purpose of preventing pimple-like deformations which may be generated after substantial completion of development, the photographic element of the present invention can be incorporated with such compounds as alkali metal fluorides and oxalates, barium salts, etc., as described in U.S. Pat. No. 3,942,987.

It is also possible to control the gradation in photographic element of the present invention by using competitive developers known by *Research Disclosure,* No. 15162 (published in November, 1976), including, for example, hydroquinone, methylhydroquinone, t-butylhydroquinone, and the like.

Further, the photographic element of the present invention can be incorporated with such compounds as 5-methylbenzotriazole, 5,6-dichlorobenzotriazole, 6-nitrobenzimidazole and histidine, which are known by U.S. Pat. No. 2,497,917.

In many cases, the alkaline processing composition used in the present invention contains uniformly dispersed pigments, such as carbon black and titanium dioxide. In such cases, known dispersing agents and surfactants can be used therewith, including, e.g., alkali metal salts of polyacrylic acids, naphthalenesulfonic acid, condensation products of naphthalenesulfonic acid and formaldehyde, polystyrenesulfonic acids, and the like.

The dye releasing redox compounds used in the present invention can be represented by the following formula (II):

$$\text{Y-D} \qquad \text{(II)}$$

wherein Y represents a component which releases imagewise a dye compound having a diffusibility different from that of the dye releasing redox compound per se represented by the formula (II) as a result of development processing under an alkaline condition. Generally, Y has a "ballast group" for rendering the dye releasing redox compound non-diffusible. D may be a dye (or dye precursor) itself or may be the dye and a group for linking the dye to Y. Typical examples of such dyes include azo dyes. One of effective examples of Y is an N-substituted sulfamoyl group.

Specific examples of Y are described in, for example, U.S. Pat. Nos. 3,928,312, 3,993,638, 4,076,529, 4,152,153, 4,055,428, 4,053,312, 4,198,235, 4,179,291, 4,149,892, 3,844,785, 3,443,943, 3,751,406, 3,443,939, 3,443,940, 3,628,952, 3,980,479, 4,183,753, 4,142,891, 4,278,750, 4,139,379, 4,218,368, 3,421,964, 4,199,355, 4,199,354, 4,278,750, 4,135,929, 4,336,322 and 4,139,389, and Japanese Patent Application (OPI) Nos. 50736/78, 104343/76, 130122/79, 110827/78, 12642/81, 16131/81, 4043/82, 650/82, 20735/82, 69033/78 and 130927/79 (the term "OPI" as used herein refers to a "published unexamined Japanese patent application").

Specific examples of D for yellow dye are described in, for example, U.S. Pat. Nos. 3,597,200, 3,309,199, 4,013,633, 4,245,028, 4,156,609, 4,139,383, 4,195,992, 4,148,641, 4,148,643 and 4,336,322, Japanese Patent Application (OPI) Nos. 114930/76 and 71072/81, and Research Disclosure, 17630 (1978) and 16475 (1977).

Specific examples of D for magenta dye are described in, for example, U.S. Pat. Nos. 3,453,107, 3,544,545, 3,932,380, 3,931,144, 3,932,308, 3,954,476, 4,233,237, 4,255,509, 4,250,246, 4,142,891, 4,207,104, and 4,287,292, and Japanese Patent Application (OPI) Nos. 106727/77, 23628/78, 36804/80, 73057/81, 71060/81 and 134/80.

Specific examples of D for cyan dye are described in, for example, U.S. Pat. Nos. 3,482,972, 3,929,760, 4,013,635, 4,268,625, 4,171,220, 4,242,435, 4,142,891, 4,195,994, 4,147,544 and 4,148,642, British Pat. No.

1,551,138, Japanese Patent Application (OPI) Nos. 99431/79, 8827/77, 47823/78, 143323/78, 99431/79 and 71061/81, European Pat. Nos. 53,037 and 53,040, and Research Disclosure, 17630 (1978), 16475 (1975) and 16475 (1977).

In the present invention, the molar ratio of the dye releasing redox compound to silver in a silver halide emulsion associated therewith is in a range of from about 50 to 0.5, preferably from about 10 to about 2.

The coating amount of the dye releasing redox compound is from $1\times10^{-4}$ to $1\times10^{-2}$ mol/m$^2$, preferably from $2\times10^{-4}$ to $2\times10^{-3}$ mol/m$^2$.

The dye image receiving element must be provided with a mordant layer comprising, e.g., poly-4-vinylpyridine latex (in particular, in polyvinyl alcohols) such as those described in U.S. Pat. No. 3,148,061; polyvinylpyrrolidones, such as those described in U.S. Pat. No. 3,003,872; or quaternary ammonium salt-containing polymers, such as those described in U.S. Pat. No. 3,239,337. Other examples of effective mordants include basic polymers described, e.g., in U.S. Pat. Nos. 2,882,156, 3,625,694 and 3,709,690. Mordants described in U.S. Pat. Nos. 2,484,430, 3,271,147 and 3,184,309 can also be effectively used. The mordant layer can be placed as a dye image-receiving layer in the light-sensitive element.

Preferably, the photographic element of the present invention is provided with a means for neutralizing alkali which is brought about from the alkaline processing composition. Alkali contained in the processing composition provides a high pH in the order, preferably, of 11 or above necessary to facilitate "image-forming processes" comprising the development of silver halide emulsions and the diffusion of dye releasing redox compounds. After the formation of transferred images has been substantially completed, the pH throughout the film unit is neutralized to a near neutral value, namely, less than 9 and preferably less than 8, so that the image-forming processes can be terminated and changes in image tones can be prevented over long periods of time. Discoloration and fading of images which would otherwise be caused by the high alkalinity can also be depressed by this reduction in pH. The pH reduction can be advantageously achieved by providing the film unit with a neutralizing layer containing an acidic substance in an amount sufficient to neutralize alkali contained in the processing composition to the above-described pH, i.e., an area concentration of the acidic substance in the neutralizing layer being equivalent to or higher than that of alkali in the spread processing solution. Preferable acidic substances include those containing acidic groups having a pKa less than 9 or containing precursors capable of giving such acidic groups by the hydrolysis thereof. Specific examples of preferable acidic substances include higher fatty acids, such as oleic acid as described in U.S. Pat. No. 2,983,606; polymerized products of acrylic acid, methacrylic acid, or maleic acid and partial esters or acid anhydrides thereof, as described in U.S. Pat. No. 3,362,819. Specific examples of polymeric acidic substances include copolymers of maleic anhydride and a vinyl monomer, such as ethylene, vinyl acetate and vinyl methyl ether, or n-butyl half esters thereof; copolymers of butyl acrylate and acrylic acid; acidic phthalates of cellulose acetates; and the like. In addition to such acidic substances, the neutralizing layer can contain such polymers as cellulose nitrates and polyvinyl acetates; as well as plasticizers as described in U.S. Pat. No. 3,557,237. The neutralizing layer may be hardened by cross-linking by means of multifunctional compounds, such as aziridine compounds and epoxy compounds. The neutralizing layer(s) may be positioned in a dye image-receiving element, a cover sheet and/or light-sensitive element. The acidic substance can be incorporated into film units in the form of microcapsules, as described in German Patent Application (OLS) No. 2,038,254.

The neutralizing layer or acidic substance-containing layer in the above case is preferably detached from the layer of spread processing solution by a neutralizing rate-adjusting layer (timing layer). This neutralizing rate-adjusting layer has the function to retard the neutralization of processing solution effected by a neutralizing layer, so as to allow the desired development and transfer to proceed well. The neutralizing rate-adjusting layer is composed mainly of such polymers as gelatin, polyvinyl alcohols, polyvinyl propyl ethers, polyacrylamides, hydroxypropylmethyl celluloses, isopropyl celluloses, partial polyvinyl butyrals, partially hydrolyzed polyvinyl acetates, and copolymers of $\beta$-hydroxyethyl methacrylate and ethyl acrylate. These polymers can be preferably hardened by cross-linking reactions, using aldehyde compounds such as formaldehyde, N-methylol compounds, or the like. Examples of the neutralizing rate-adjusting layers are described in U.S. Pat. Nos. 3,455,686, 4,009,030 and 3,785,815, Japanese Patent Application (OPI) Nos. 2431/77 and 14415/77, U.S. Pat. Nos. 3,847,615, 3,783,075, 3,785,815, 4,088,493, 3,362,819, 3,706,557 and 3,421,893, Japanese Patent Publication No. 4214/73, German Patent Application (OLS) No. 1,622,936, *Research Disclosure,* 15162, No. 151 (1976), etc. The thickness of the neutralizing rate-adjusting layer is preferably 2 to 20 microns.

The processing composition described above can be preferably used by putting it in a rupturable container, as described in U.S. Pat. Nos. 2,543,181, 2,643,886, 2,653,732, 2,723,051, 3,056,491, 3,056,492, 3,152,515, etc.

The photographic element of the present invention can be in the form of a film unit of the type of which photographic processing can be effected by passing it through a pair of juxtaposed pressure-applying members after being imagewise exposed. Such a film unit may comprise, e.g., the following elements:

(1) a support;
(2) a light-sensitive element;
(3) a dye image-receiving element; and
(4) an alkaline processing composition element.

An embodiment of the superposed, integrated type which is most recommendable for the practice of the present invention is described in British Pat. No. 1,330,524. In this embodiment, an image-receiving layer, a substantially opaque light-reflecting layer (e.g., a $TiO_2$ layer or a carbon black layer), and one or a plurality of light-sensitive layers (light-sensitive elements) described hereinbefore are provided in this order by coating them on a transparent support. A transparent cover sheet is superposed thereon so as to have a face-to-face relation. A rupturable container holding an alkaline processing composition containing opacifying agents (e.g., carbon black) for light shielding is disposed so as to be adjacent to the top layer (protective layer) of the above-described light-sensitive layer and to the transparent cover sheet. Such a film unit is photoexposed in a camera through the transparent cover sheet and taken out therefrom, whereby the container is ruptured by the pressure-applying members and uniformly spreads the processing composition containing opacifying agents between the light-sensitive layer and the cover sheet. Thus, the light-sensitive element layers are shielded from light in a sandwich form and the film unit can be developed in the light. After completion of development, a transparent support having coated thereon a mordant layer having a transferred dye image may be separated from the remaining film unit.

As previously stated, film units of the above-described type are recommended to have a built-in neutralizing mechanism. The neutralizing mechanism can be preferably a neutralizing layer provided in the cover sheet. If desired, a timing layer can be additionally provided on the side where processing composition is spread.

Another form of useful integrated film units to which the photographic element of the present invention can be applied is described in U.S. Pat. Nos. 3,415,644, 3,415,645, 3,415,646, 3,647,487, 3,993,486 and 3,635,707.

In other preferable embodiments, a dye image-receiving element having a layer arrangement comprising a support, a neutralizing layer, a neutralizing rate-adjusting layer and a mordant layer is superposed on a light-sensitive element comprising a support having coated thereon one or a plurality of light-sensitive layers in a face-to-face relationship. In the embodiments of this type, processing can be effected by spreading the above-described alkaline processing solution between the two elements. The image receiving element can be peeled apart after the formation of transferred images. It is also possible to use a transparent support for the image-receiving element and to provide a light-reflecting layer between the image-receiving layer and the light-sensitive layer(s), so that transfer-red images can be viewed without peeling apart the image-receiving element, as is described in U.S. Pat. No. 3,415,645.

The compound according to the present invention can also be used in photographic elements designed for color diffusion transfer processes utilizing dye developers. A dye developer usable in the present invention is a compound having a dye moiety and silver halide-developing group within the same molecule, as described in U.S. Pat. No. 2,983,606. Advantageous dye developers include those having light absorptions adoptable for the subtractive color reproduction process, that is, those capable of providing yellow, magenta or cyan colors. Dye moieties which provide such colors can be derived, e.g., from azo, anthraquinone, phthalocyanine, nitro, quinoline, azomethine, indamine, indoaniline, indophenol and azine dyes. The silver halide-developing group is a group capable of developing exposed silver halides. The group preferably loses its hydrophilicity as a result of oxidation. Benzenoid developing groups, i.e., aromatic developer groups which can be converted into quinoids through oxidation thereof are generally suitable. Hydroquinonyl groups are preferably used as a developer group. Other examples of suitable developer groups include ortho-dihydroxyphenyl group and o- or p-amino-substituted hydroxyphenyl groups. In preferable dye developers, the dye moiety and the developer group are separated by a saturated fatty group, such as ethylene, in order not to allow the dye moiety and the developer group to conjugate electronically. 2-Hydroquinonylethyl and 2-hydroquinonylpropyl groups can be particularly useful. The dye moiety and the developer group can be linked by a covalent bond as in the above cases, or by a coordinate bond, as is disclosed in U.S. Pat. Nos. 3,551,406, 3,563,739, 3,597,200 and 3,674,478.

It can be advantageous in some types of diffusion transfer photographic materials to temporarily convert the dye moiety to a colorless leuco form through reduction thereof, as is described in U.S. Pat. No. 3,320,063; or to temporarily shift its spectral absorption to shorter wavelengths of the spectrum by acylating hydroxyl or amino groups contained in auxochromes thereof, as is described in U.S. Pat. Nos. 3,230,082, 3,307,947 and 3,579,334, and Japanese Patent Application (OPI) No. 26541/75. Dye developers having a dye moiety containing a hydroxyl group in the ortho position of an azo bond can also be used with advantage because of their superiority in absorption properties and image stabilities, as is described in U.S. Pat. No. 3,229,041. Other examples of dye developers suited for diffusion transfer color photography are disclosed in U.S. Pat. Nos. 2,983,605, 2,992,106, 3,047,386, 3,076,808, 3,076,820, 3,077,402, 3,126,280, 3,131,061, 3,134,762, 3,135,604, 3,135,605, 3,135,606, 3,135,734, 3,141,772, 3,142,565, 3,173,906, 3,183,090, 3,246,985, 3,230,086, 3,309,199, 3,230,083, 3,239,339, 3,347,672, 3,347,673, 3,245,790, 3,230,082, etc.

In the present invention, there may be used auxiliary developers, including, e.g., 1-phenyl-3-pyrazolidones as described in U.S. Pat. No. 3,039,869; hydroquinone derivatives, such as 4'-methylphenylhydroquinone and t-butylhydroquinone; and catechol derivatives, such as 4-methoxycatechol, as described in U.S. Pat. No. 3,617,227. In addition to the above auxiliary developers, it is also possible to use hydroquinone and its derivatives having substantially sufficient solubilities in water. Examples of such compounds include hydroquinone, hydroxyhydroquinone, chlorohydroquinone, methylhydroquinone, methoxyhydroquinone, hydroxymethylhydroquinone, aminohydroquinone hydrochloride, 2,5-diaminohydroquinone hydrochloride, aminomethylhydroquinone hydrochloride, aminoethylhydroquinone hydrobromide, 2,5-dihydroxythiophenol, and the like. There may also be used amyl gallates described in Japanese Patent Application (OPI) No. 83440/74 and spiro compounds described in Japanese Patent Application (OPI) Nos. 40128/74 and 84238/74. The auxiliary developers can be used alone, or two or more of these auxiliary developers may be used in combination. The auxiliary developers can be incorporated into the alkaline processing composition.

The present invention is hereunder described in greater detail by reference to the following examples but it should be understood that the scope of this invention is by no means limited to such examples.

EXAMPLE 1

A light-sensitive material was prepared by coating the following layers, in the order recited, on a transparent polyethylene terephthalate film support.

(1) an image-receiving layer containing 4.0 g/m$^2$ of copoly[styrene-N-vinylbenzyl-N,N,N-trihexyl ammonium chloride] and 4.0 g/m$^2$ of gelatin;

(2) a white-reflecting layer containing 22 g/m$^2$ of titanium dioxide and 2.2 g/m$^2$ of gelatin;

(3) an opaque layer containing 2.7 g/m$^2$ of carbon black and 2.7 g/m$^2$ of gelatin;

(4) a layer containing 0.50 g/m$^2$ of cyan dye-releasing redox compound having the following formula:

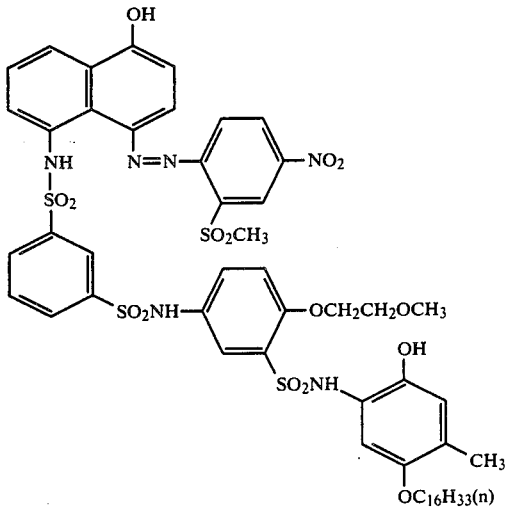

0.50 g/m$^2$ of N,N-diethyllaurylamide and 1.5 g/m$^2$ of gelatin;

(5) a layer containing a red-sensitive internal latent image type silver bromide emulsion (gelatin: 1.1 g/m$^2$, silver: 1.4 g/m$^2$), 0.015 g/m$^2$ of 1-acetyl-2-[4-(2,4-di-t-pentylphenoxyamido)phenyl]hydrazine and 0.067 g/m$^2$ of sodium 2-pentadecylhydroquinone-5-sulfonate;

(6) a color contamination-preventing layer containing 1.0 g/m$^2$ of gelatin, 1.0 g/m$^2$ of 2,5-di-t-pentadecylhydroquinone and 0.5 g/m$^2$ of tricresyl phosphate;

(7) a layer containing 0.80 g/m$^2$ of magenta dye-releasing redox compound of the following formula:

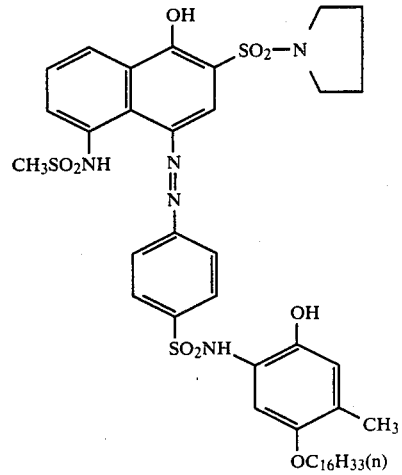

0.20 g/m$^2$ of N,N-diethyllaurylamide and 1.2 g/m$^2$ of gelatin;

(8) a layer containing a green-sensitive internal latent image type silver bromide emulsion (gelatin: 1.1 g/m$^2$, silver: 1.4 g/m$^2$), 0.015 g/m$^2$ of 1-acetyl-2-[4-(2,4-di-t-pentylphenoxyacetamido)phenyl]-hydrazine and 0.067 g/m$^2$ of sodium 2-pentadecylhydroquinone-5-sulfonate;

(9) a color contamination-preventing layer containing 1.0 g/m$^2$ of gelatin, 0.5 g/m$^2$ of 2,5-di-t-pentadecylhydroquinone and 0.5 g/m$^2$ of tricresyl phosphate;

(10) a layer containing 1.0 g/m$^2$ of yellow dye releasing redox compound of the following formula:

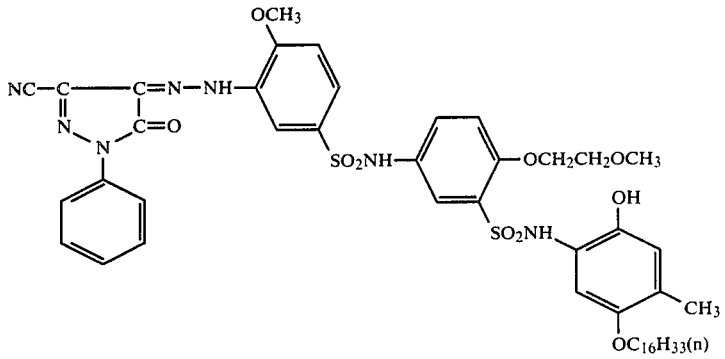

0.25 g/m$^2$ of N,N-diethyllaurylamide and 1.0 g/m$^2$ of gelatin;

(11) a layer containing a blue-sensitive internal latent image type silver bromide emulsion (gelatin: 1.1 g/m$^2$, silver: 1.4 g/m$^2$), 0.015 g/m$^2$ of 1-acetyl-2-[4-(2,4-di-t-pentylphenoxyacetamido)-phenyl]hydrazine and 0.067 g/m$^2$ of sodium 2-pentadecylhydroquinone-5-sulfonate; and

(12) a protective layer containing 1.3 g/m$^2$ of gelatin, 0.9 g/m$^2$ of polyethylacrylate latex, 0.5 g/m$^2$ of Tinuvin and 0.026 g/m$^2$ of triacryloylperhydrotriazine hardener.

This light-sensitive material was imagewise exposed through a continuous optical wedge, using a tungsten light of 2,854° K. converted to 4,800° K. through a Davis Gibson filter (maximum exposure amount: 10 C.M.S.). The exposed material is then developed either by Processing Composition A (control) having the composition set forth below, or by Processing Composition B according to the present invention prepared by additionally incorporating 15 g of Compound (1) shown hereinbefore into Processing Composition A.

| Processing Composition A (control): | |
|---|---|
| Potassium Hydroxide | 48 g |
| 4-Hydroxymethyl-4-methyl-1-phenyl-3-pyrazolidinone | 8 g |
| 5-Methylbenzotriazole | 2.5 g |
| t-Butylhydroquinone | 0.07 g |
| Sodium Sulfite | 1.5 g |
| Benzyl Alcohol | 1.5 ml |
| Carboxymethyl Cellulose | 61 g |
| Carbon Black | 150 g |
| Water to make | 1 l |

Processing Compositions B to F contain compounds shown in Table 1 in addition to the same composition as that of the Processing Composition A, respectively. Processing Composition G contains the same composition as that of the Processing Composition A except for containing an increased amount of sodium sulfite for control.

A cover sheet was prepared by coating the following layers, in the order recited, on a transparent polyethylene terephthalate film base.

(1) a neutralizing layer having a thickness of 7 microns and containing 17 g/m$^2$ of polyacrylic acid, 0.06 g/m$^2$ of N-hydroxysuccinimidobenzenesulfonate and 0.5 g/m$^2$ of ethylene glycol;

(2) a timing layer having a thickness of 2 microns and consisting of cellulose acetate (degree of acetylation: 54); and (3) a timing layer having a thickness of 4 microns and consisting of vinylidene chloride-acrylic acid copolymer latex.

The development of the light-sensitive material was carried out by uniformly spreading Processing Compositions A to G at a thickness of 80$\mu$ between the light-sensitive material and the cover sheet obtained above, by passing them through a pair of juxtaposed rollers at a temperature of 25° C.

The densities of the light-sensitive material were measured 1 hour and 28 days after the spread of the processing compositions. Results obtained are shown in Table 1.

TABLE 1

| Processing Composition | Compound (g) | | After 1 Hour $D_{max}$ | After 1 Hour $D_{min}$ | After 28 Days $D_{max}$ | After 28 Days $D_{min}$ | Difference between after 28 Days and after 1 Hour $\Delta D_{max}$ | Difference between after 28 Days and after 1 Hour $\Delta D_{min}$ |
|---|---|---|---|---|---|---|---|---|
| A (control) | — | B | 1.60 | 0.22 | 1.63 | 0.28 | 0.03 | 0.06 |
| | | G | 1.89 | 0.22 | 2.02 | 0.25 | 0.13 | 0.03 |
| | | R | 2.26 | 0.36 | 2.31 | 0.39 | 0.05 | 0.03 |
| B | Compound (1) (12.9 g) | B | 1.58 | 0.22 | 1.62 | 0.25 | 0.04 | 0.03 |
| | | G | 1.87 | 0.22 | 2.00 | 0.25 | 0.13 | 0.03 |
| | | R | 2.26 | 0.36 | 2.29 | 0.39 | 0.03 | 0.03 |
| C | Compound (2) (14.0 g) | B | 1.58 | 0.22 | 1.62 | 0.25 | 0.04 | 0.03 |
| | | G | 1.88 | 0.22 | 2.01 | 0.25 | 0.13 | 0.03 |
| | | R | 2.24 | 0.36 | 2.27 | 0.39 | 0.03 | 0.03 |
| D | Compound (5) (16.1 g) | B | 1.59 | 0.22 | 1.61 | 0.25 | 0.02 | 0.03 |
| | | G | 1.88 | 0.22 | 2.00 | 0.25 | 0.12 | 0.03 |
| | | R | 2.27 | 0.36 | 2.29 | 0.39 | 0.02 | 0.03 |
| E | Compound (9) (15.8 g) | B | 1.60 | 0.22 | 1.62 | 0.26 | 0.02 | 0.04 |
| | | G | 1.88 | 0.22 | 2.02 | 0.25 | 0.14 | 0.03 |
| | | R | 2.26 | 0.36 | 2.28 | 0.39 | 0.02 | 0.03 |

TABLE 1-continued

| Processing Composition | Compound (g) | | After 1 Hour $D_{max}$ | After 1 Hour $D_{min}$ | After 28 Days $D_{max}$ | After 28 Days $D_{min}$ | Difference between after 28 Days and after 1 Hour $\Delta D_{max}$ | Difference between after 28 Days and after 1 Hour $\Delta D_{min}$ |
|---|---|---|---|---|---|---|---|---|
| F | Compound (10) (24.6 g) | B | 1.59 | 0.22 | 1.62 | 0.25 | 0.03 | 0.03 |
| | | G | 1.88 | 0.22 | 1.99 | 0.25 | 0.11 | 0.03 |
| | | R | 2.24 | 0.36 | 2.27 | 0.39 | 0.03 | 0.03 |
| G (comparison) | Sodium Sulfite (10.0 g) | B | 1.61 | 0.22 | 1.63 | 0.28 | 0.02 | 0.06 |
| | | G | 1.90 | 0.22 | 2.02 | 0.25 | 0.12 | 0.03 |
| | | R | 2.26 | 0.36 | 2.30 | 0.39 | 0.04 | 0.03 |

$D_{max}$: Maximum Density,
$D_{min}$: Minimum Density

The above table indicates that Processing Compositions B to F incorporated with a compound according to the present invention shows a diminished increase in blue light-filtered density ($D_{min}$) with the lapse of time (in other words, improvement in stains in white areas) over the control Processing Composition A. The Processing Composition G for comparison which contains an increased amount of sodium sulfite causes stains in white areas in the same amount of stains as the Processing Composition A and, thus, it exerts no effect.

EXAMPLE 2

A light-sensitive material was prepared by coating the following layers, in the order recited, on a transparent polyethylene terephthalate film support.

(1) an image-receiving layer containing 4.0 g/m$^2$ of copoly[styrene-N-vinylbenzyl-N,N,N-trihexylammonium chloride] and 4.0 g/m$^2$ of gelatin;

(2) a white reflecting layer containing 22 g/m$^2$ of titanium dioxide and 2.2 g/m$^2$ of gelatin;

(3) an opaque layer containing 2.7 g/m$^2$ of carbon black and 2.7 g/m$^2$ of gelatin;

(4) a layer containing 0.50 g/m$^2$ of cyan dye releasing redox compound having the following formula:

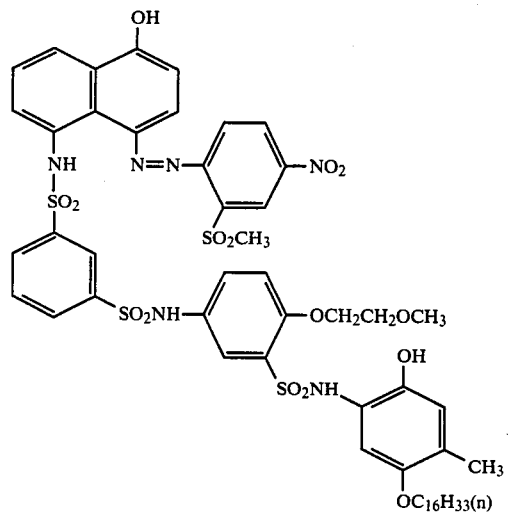

0.50 g/m$^2$ of N,N-diethyllaurylamide and 1.5 g/m$^2$ of gelatin;

(5) a layer containing a red-sensitive internal latent image type silver bromide emulsion (gelatin: 1.1 g/m$^2$, silver: 1.4 g/m$^2$), 0.015 g/m$^2$ of 1-acetyl-2-[4-(2,4-di-t-pentylphenoxyacetamido)phenyl]-hydrazine and 0.067 g/m² of sodium 2-pentadecylhydroquinone-5-sulfonate; and (6) a color contamination-preventing layer containing 1.0 g/m² of gelatin, 1.0 g/m² of 2,5-di-t-pentadecylhydroquinone and 0.5 g/m² of tricresyl phosphate.

The light-sensitive material was imagewise exposed through a continuous optical wedge, using a tungsten light of 2,854° K. converted to 4,800° K. through a Davis Gibson filter (maximum exposure amount: 10 C.M.S.).

A cover sheet was prepared in a similar manner as in Example 1. The exposed light-sensitive material and the cover sheet were processed in a similar manner as in Example 1.

The densities of the samples were measured after 1 hour and again after 28 days from the time of spread of the processing compositions. Results obtained are shown in Table 2.

TABLE 2

| Processing Composition | After 1 Hour $D_{min}$ (B) | After 28 Days $D_{min}$ (B) | Difference between after 28 Days and after 1 Hour $\Delta D_{min}$ (B) |
|---|---|---|---|
| A (control) | 0.21 | 0.27 | 0.06 |
| B | 0.21 | 0.24 | 0.03 |
| C | 0.21 | 0.24 | 0.03 |
| D | 0.21 | 0.24 | 0.03 |
| E | 0.21 | 0.25 | 0.04 |
| F | 0.21 | 0.24 | 0.03 |

The above table indicates that the increase in $D_{min}$ (B) (i.e., staining in white areas) with the lapse of time can be decreased by the use of the processing composition of the present invention incorporated with a compound according to the present invention, even in the case of a light-sensitive material containing no yellow color releasing redox compounds.

EXAMPLE 3

A light-sensitive material, a cover sheet and Processing Compositions A to D and F were prepared in the same manner as in Example 1.

The processing compositions were charged, under nitrogen atmosphere, into pod-shaped containers made of lead foil coated with polyvinyl chloride film. The resulting containers were sealed, heated to a temperature of 60° C., and maintained at the same temperature for 3 or 6 days. The compositions were then spread at room temperature between the light-sensitive material and the cover sheet in the same manner as in Example 1. The densities of the samples were measured after 1 hour. Results obtained are shown in Table 3.

TABLE 3

| Processing Composition | $D_{max}$ (B) No Deterioration Test | 60° C. for 3 Days | 60° C. for 6 Days |
|---|---|---|---|
| A (control) | 1.66 | 1.32 | 1.07 |
| B | 1.60 | 1.56 | 1.50 |
| C | 1.60 | 1.57 | 1.48 |
| D | 1.62 | 1.46 | 1.36 |
| F | 1.62 | 1.43 | 1.32 |

The above table indicates that Processing Compositions B to D and F incorporated with a compound according to the present invention provides a significant improvement in preventing the reduction in $D_{max}$ over the lapse of time with heating, compared with the control Processing Composition A.

While the invention has been described in detail and with reference to specific embodiments thereof, it will be apparent to one skilled in the art that various changes and modifications can be made therein without departing from the spirit and scope thereof.

What is claimed is:

1. A color diffusion transfer photographic element comprising at least one light-sensitive element containing a silver halide emulsion layer and an alkaline processing composition element, said alkaline processing composition element containing a compound which is an aliphatic sulfinic acid, an aromatic sulfinic acid or a salt thereof.

2. A color diffusion transfer photographic element as claimed in claim 1, wherein the silver halide emulsion layer is associated with a dye image-providing material.

3. A color diffusion transfer photographic element as claimed in claim 1, wherein the compound is represented by the general formula (I):

$$(Y\text{-}SO_2)_nM \qquad (I)$$

wherein M represents a hydrogen atom, an alkali metal atom, an alkaline earth metal atom, an organic base or an ammonium group, Y represents an alkyl group, a substituted alkyl group, an aryl group, or a substituted aryl group, and n is 1 or 2.

4. A color diffusion transfer photographic element as claimed in claim 1, wherein said light-sensitive element further comprises a mordant layer (dye image-receiving layer) and said silver halide emulsion layer is associated with a dye image-providing material, and wherein said alkaline processing composition element comprises a container containing an alkaline processing composition, and wherein said photographic element further comprises a cover sheet.

5. A color diffusion transfer photographic element as claimed in claim 1, wherein the photographic element contains a cover sheet having a neutralizing system, the light-sensitive element further comprises a support having thereon at least a mordant layer and said silver halide emulsion layer is associated with a dye image-providing material, and the alkaline processing composition element comprises a rupturable container having an alkaline processing composition and is juxtaposed between the light-sensitive element and the cover sheet.

6. A color diffusion transfer photographic element as claimed in claim 4, wherein the dye image-providing material is a dye-releasing redox compound.

7. A color diffusion transfer photographic element as claimed in claim 5, wherein the cover sheet comprises a support having thereon at least a neutralizing layer.

8. A color diffusion transfer photographic element as claimed in claim 1, wherein the photographic element further comprises a support and a dye image-receiving element comprising at least a mordant layer, and the silver halide emulsion layer is associated with a dye image-providing material.

9. A color diffusion transfer photographic element as claimed in claim 1, wherein the photographic element contains a dye-image receiving element comprising a support having thereon at least a mordant layer, the light-sensitive element further comprises a support having thereon said silver halide emulsion layer, said silver halide emulsion layer is associated with a dye image-providing material, and the alkaline processing composition element comprises a rupturable container containing an alkaline processing composition and is juxtaposed between the light-sensitive element and the dye image-receiving element.

10. A color diffusion transfer photographic element as claimed in claim 8, wherein the dye image-receiving element comprises a support having thereon at least a neutralizing layer, and at least a mordant layer.

11. A color diffusion transfer photographic element as claimed in claim 1, wherein the alkaline processing composition element contains an alkaline processing composition which is substantially free from oxygen.

12. A color diffusion transfer photographic element as claimed in claim 1, further containing a 3-pyrazolidinone series compound or precursor thereof.

13. A color diffusion transfer photographic element as claimed in claim 1, wherein a 3-pyrazolidinone series compound is incorporated in the alkaline processing composition element.

14. A color diffusion transfer photographic element as claimed in claim 1, further containing an aminophenol series compound or a hydroquinone series compound.

15. A color diffusion transfer photographic element, as claimed in claim 3, wherein Y is an alkyl group, a substituted alkyl group containing 5 to 30 carbon atoms or a substituted group thereof.

16. A color diffusion transfer photographic element as claimed in claim 3, wherein Y is a naphthyl group, a phenyl group or a substituted group thereof.

17. A color diffusion transfer photographic element as claimed in claim 3, wherein M is a sodium atom or a potassium atom.

18. A color diffusion transfer photographic element as claimed in claim 3, wherein M represents an ammonium group.

19. A color diffusion transfer photographic element as claimed in claim 3, wherein M represents a hydrogen atom.

20. A color diffusion transfer photographic element as claimed in claim 3, wherein n is 1.

21. A color diffusion transfer photographic element as claimed in claim 1, wherein the compound in the alkaline processing composition element is selected from the group consisting of:

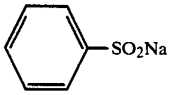

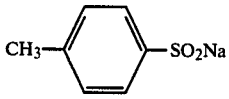

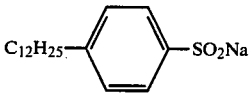

-continued

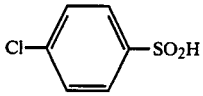

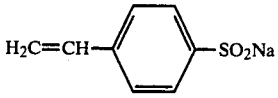

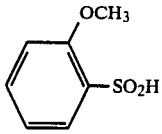

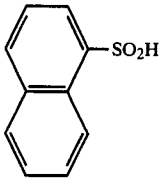

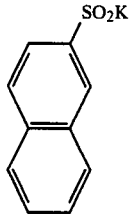

$C_8H_{17}SO_2Na$
$C_{16}H_{33}SO_2Na$

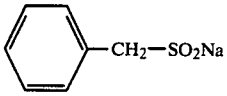

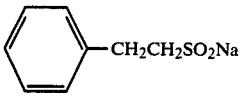

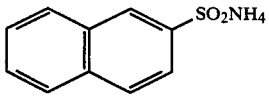

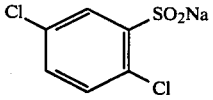

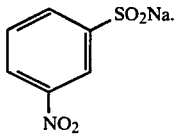

* * * * *